United States Patent [19]

Neumann et al.

[11] Patent Number: 4,790,807

[45] Date of Patent: Dec. 13, 1988

[54] CENTRIFUGE ARRANGEMENT

[75] Inventors: Hans-Jürgen Neumann, St. Wendel; Wolfram Weber, Spiesen-Elversberg, both of Fed. Rep. of Germany

[73] Assignee: Fresenius AG, Hamburg, Fed. Rep. of Germany

[21] Appl. No.: 100,236

[22] Filed: Sep. 23, 1987

[30] Foreign Application Priority Data

Sep. 24, 1986 [DE] Fed. Rep. of Germany ..... 3632500

[51] Int. Cl.[4] ..... B04B 7/08

[52] U.S. Cl. ..... 494/45

[58] Field of Search ..... 494/45, 21, 18, 85, 494/36, 37; 422/72; 210/781, 782, 783

[56] References Cited

U.S. PATENT DOCUMENTS 4,430,072 2/1984 Kellogg ..... 494/45

4,447,221 5/1984 Mulzet ..... 494/45

4,708,712 11/1987 Mulzet ..... 494/45

*Primary Examiner*—Robert W. Jenkins

*Attorney, Agent, or Firm*—James P. Ryther

[57] ABSTRACT

The invention relates to a centrifuge arrangement having a centrifuge rotor comprising a drive disc (18) connected to a drive source. Furthermore, the centrifuge rotor comprises at least one separation container (1, 32) which comprises a separation passage (6) and a separation chamber (9) whose outlet and inlet passages lead to the center of the drive disc (18). Advantageously, the separation container (1, 32) is made as self-supporting part of rigid or semi-rigid but flexible material and this makes it possible to insert said container easily into the drive disc (18) and in addition provides advantages in the production of the centrifuge arrangement according to the invention.

16 Claims, 4 Drawing Sheets

CENTRIFUGE ARRANGEMENT

DESCRIPTION

The invention relates to a centrifuge arrangement according to the preamble of claim 1.

A centrifuge arrangement according to the preamble is known for example from DE-OS No. 2,821,055. This publication discloses a centrifuge arrangement having a centrifuge rotor whose centre portion comprises a passage closed on three sides. In said passage a separation container can be inserted. Since said separation container consists of semi-rigid material during the centrifuging it bears against the walls of the passage under the high pressures occurring, being supported thereby at the side walls and bottom wall of said passage.

A disadvantage here is however that the final form of the separation passage of the separation container cannot be obtained until after insertion into the passage present in the centre portion of the centrifuge rotor. However, for production reasons this passage or channel can never be dimensioned and made exactly enough for the separation container to bear during the centrifuging uniformly on all three sides of the channel and this in turn has a negative influence on the separation efficiency of the known centrifuge arrangement. In addition, the channel or passage disposed in the centrifuge body is limited in dimensions so that only separation containers of specific dimensions can be inserted.

A further centrifuge arrangement is known from DE-OS No. 2,821,057, FIG. 1 thereof, which however corresponds substantially to the centrifuge arrangement according to the preamble and thus also has the disadvantages thereof.

A further centrifuge arrangement is known from DE-OS No. 2,624,154, FIG. 4. This centrifuge arrangement comprises a centrifuge rotor which includes a drive disc, a drive source connected to the drive disc and a separation container. The separation container itself comprises at least one circular separation channel or passage and at least one separation chamber connected thereto and also connected to an outlet passage whilst the separation passage is connected to an inlet passage. These passages lead from their connectios to the separation chamber or the separation passage to the centre of the separation container or drive disc on which the separation container is secured.

In the known centrifuge arrangement the separation container consists of a flexible resilient material such as polyvinyl chloride which is suitable for medical purposes and said container is for example welded together from two equally shaped circular pieces of said material. After fitting the inlet and outlet passages to the separation container the latter is introduced into the drive disc of the centrifuge rotor and secured thereto by means of an additional cover. Furthermore, to compensate pressure and prevent bursting of the separation container a hydraulic fluid must be introduced between the separation container and the surface of the centrifuge rotor.

Because of the use of flexible material for the separation container this known centrifuge arrangement has however the disadvantage that for said container a relatively high production expenditure is necessary because firstly two equally shaped pieces of flexible material must be made, then they must be connected exactly together and then using a hydraulic protective fluid attached to the centrifuge rotor. Moreover, there is the diadvantage that relatively large production tolerances are present for flexible material and the passage form is not completely uniform without diameter and cover fluctuations, leading to eddies and turbulences due to passage form fluctuations and this in turn has a negative effect on the centrifuge arrangement.

The problem underlying the present invention is therefore to provide a centrifuge arrangement of the type set forth in the preamble of claim 1 which permits good centrifuging results even when centrifuging various media having different properties.

The solution of this problem is effected by the features of claim 1.

The centrifuge arrangement according to the invention permits a completely uniform passage form of the separation container having very small diameter and height fluctuations. This in turn permits in operation a particularly advantageous laminar and uniform flow of the material to be centrifuged, giving continuously good centrifuging results even when processing very varied media.

Firstly, one result is that the separation container can be made with exact dimensions and in simple manner and inserted extremely easily into the centrifuge rotor. This simplifies in general the handling of the centrifuge arrangement according to the invention and furthermore material and cost reductions of the separation container, which may be made as dispensable part, are obtained by simple and easy construction. The separation chamber may for example consist merely of two parts, the separation chamber housing and the closure lid.

There is also the advantage that the separation container need not be individually balanced but only in conjunction with the drive disc, i.e. only once per centrifuge arrangement. Balancing of the dispensable component is not necessary, leading to considerable simplifications with asymmetrical passage arrangements. Furthermore, the separation container does not require its own connection to the drive source, which is very complicated to make, this connection being present only once to the drive disc.

Also, in advantageous manner smaller production tolerances are obtained and a better surface structure and it is even possible to polish the separation container to high gloss.

A further considerable advantage which in particular considerably improves the centrifuging results obtainable with the centrifuging arrangement according to the invention is the completely uniform passage form having a very small diameter and height fluctuations due to using rigid or semi-rigid material. This makes it possible when operating the centrifuge arrangement according to the invention to achieve a particularly advantageous laminar uniform flow of the material to be centrifuged, as is particularly important for example with thrombocytepoor plasma.

Furthermore, by using rigid or semi-rigid material it is possible to obtain transparent regions permitting for example the provision of window areas for providing measuring devices, such as light barriers.

The rigid and semi-rigid material further makes it possible to make a very smooth transparent surface and thus obtain observation with stroboscope light of the centrifuging operation.

Finally, easy flushability is obtained due to the constant passage forms over the entire length of the separation container, independent of the filling material and pressure. For the pressure arising in the separation container at a sepcific speed of rotation depends on the centrifugal acceleration and the specific weight of the filling material and with resilient separation containers leads to various passage thicknesses.

A further advantageous separation can be achieved in that two interconnected separation containers for a two-stage separation are arranged on a drive disc.

The subsidiary claims relate to a further advantageous development of the centrifuge arrangement according to the invention.

Further details, features and advantages of the present invention will be apparent from the following description of an example of embodiment with the aid of the drawings, wherein.

Figure 1:
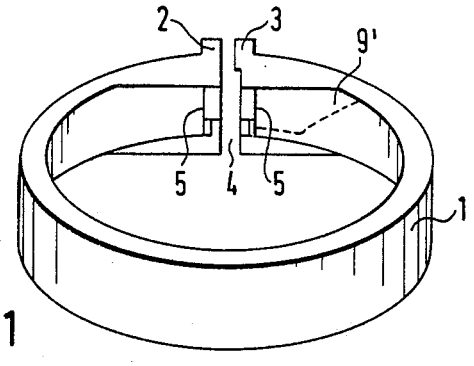
FIG. 1 is a perspective view of a separation container of the centrifuge arrangement according to the invention.

In FIG. 1 a separation container 1 of a centrifuge arrangement according to the invention is shown. The separation container 1 is self-supporting part of rigid or semi-rigid material, the material having however a certain flexibility. This has the advantage that the separation container is on the one hand dimensionally stable but because of its flexibility can be deformed to a certain extent, in particular can be reduced in its diameter, thus considerably simplifying the handling thereof in particular on assembling the centrifuge arrangement according to the invention.

As further apparent from FIG. 1 the separation container according to the invention is made as circular ring which is however not closed. Thus, the separation container 1 has two oppositely disposed ends 2, 3 defining an intermediate space 4. This makes it possible to move the two ends 2, 3 towards each other due to the flexibility of the material of the separation container 1 by pressing said ends together until they come to bear on each other. For this purpose for example the end region 3 can be provided with a suitable grip portion 5. Further details of the separation container 1 will be explained hereinafter with the aid of FIG. 4.

In the plan view of the separation container 1 in FIG. 4 once again an annular form is indicated. It is further apparent that the separation container 1 has in the example a separation channel or passage 6 extending almost round the entire periphery of the separation container 1. For reasons of clarity the complete circular separation passage has not been shown. Furthermore, in the example one end region of the separation passage 6 lying at the end 2 of the separation container 1 is provided with a tube member 8 which in the final assembled state is connected to output passages through which the centrifuged components are conducted off. As apparent in the illustration of FIG. 4 at the end region 4 a separation chamber 9 is also disposed which has a widened cross-section compared with the separation passage 6 and the height of which is preferably reduced compared with the height of the separation passage, for which purpose an inclined face 9' can be provided extending from the upper end region of the separation passage 6 into a top region of the separation chamber 9 not shown in detail in FIG. 4. If this inclined face 9' indicated in FIG. 1 in dashed line is provided it serves to reduce the layer thickness, for example for attaching an optical detector system. It is however also possible to make the separation chamber 9 in its height corresponding to the height of the separation passage 6, i.e. not to provide a reduction in height.

Figure 4:
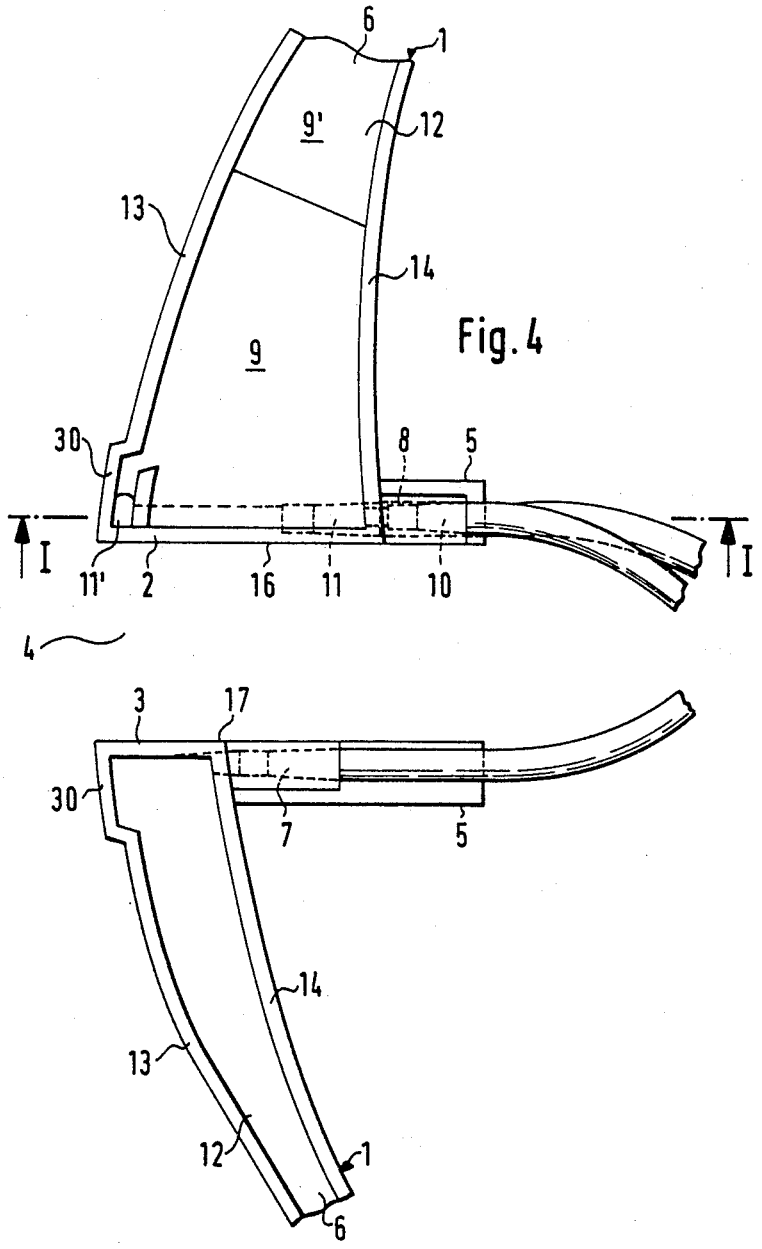
FIG. 4 is a plan view of the separation container according to FIG. 1.
Figure 5:
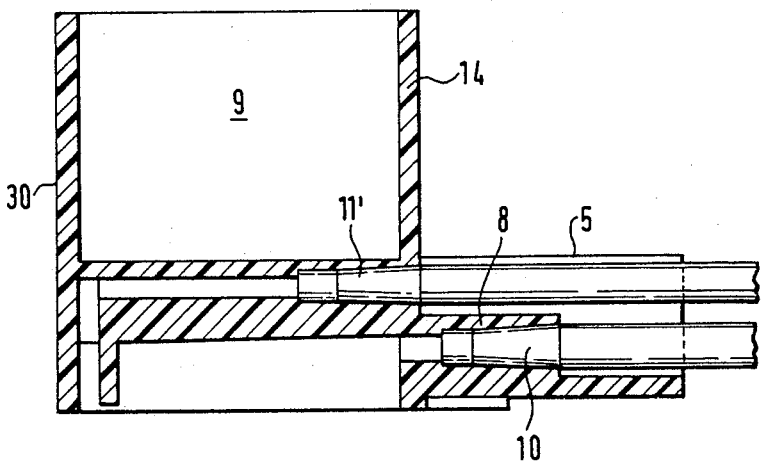
FIG. 5 is a section I—I according to FIG. 4 through the separation chamber and FIG. 6 is a plan view of the separation container with a two-stage separation.

As further apparent from FIG. 4 and FIG. 5 the tube member 8 has three differently long withdrawal tubes 10, 11, 11' which extend into different regions of the separation chamber 9 so that it is possible to separately withdraw by means of flexible tubes through the respective tubes 10, 11, 11' the regions of different centrifuged components forming in the separation chamber 9. The radially shortest tube 10 is used in the separation of blood for withdrawing the lightest blood component, that is the plasma, while the radially longest tube 11' is used to remove the heaviest component, i.e. the erythrocytes. The connecting tube 11 possibly lying radially substantially in the centre is on the other hand used to withdraw leucocytes and thrombocytes ("buffy coat"). In a simple plasma separation this tube may be omitted.

In the embodiment shown in FIG. 4 only one separation passage 6 is provided but it is also possible to provide a plurality of interconnected separation passages which for example can be arranged lying concentrically one within the other.

Figure 3:
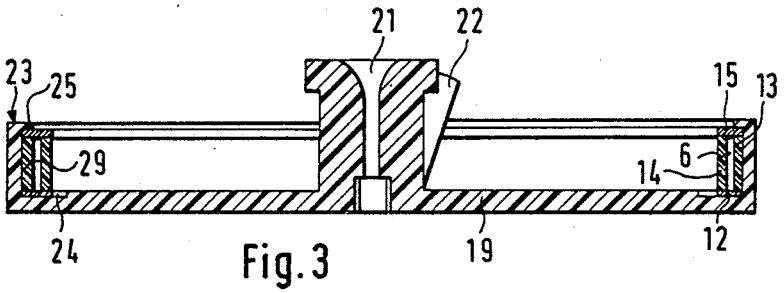
FIG. 3 is a section through the separation container and the drive disc in the assembled state.

As apparent from FIG. 3 the separation passage 6 has at least in relatively large areas a rectangular cross-section and includes a passage bottom 12 and fixed passage walls 13 and 14 which are fixedly connected to the passage bottom and disposed substantially perpendicularly thereon. The correspondingly then remaining open side is closed by means of a permanently applied liquid-sealing cover 15. The separation chamber 9 also comprises the walls 13, 14 and the channel bottom 12, the walls 13, 14 extending in a gradually increasing distance from each other so that the form of the separation chamber 9 shown in detail in FIG. 4 results. Of course, the separation chamber 9 is also provided with the cover 15 which in its form is adapted to the path of the walls 13, 14 defining the separation chamber. Furthermore, a wall 16 is provided which connects the walls 13, 14 and completely closes the separation chamber 9. A corresponding wall 17 is also provided in the end region 3 so that there as well the separation passage 6 is closed all round and communicates with the outer area solely via the connecting tube 7 and a recess provided in the wall 14.

It is additionally pointed out regarding the cover 15 providing a fluid seal effect that said cover may be larger than the opening of the passage 6, the length of the cover 15 being somewhat greater than the length of the open passage 6 and its width being at no point substantially greater than the distance of the outer faces of the passage walls 13, 14 from each other but being possibly greater than the distance of the inner faces of the passage walls 13, 14 from each other. The cover may also consist of a plurality of parts which close various portions of the passages.

Furthermore, the face formed by the passage bottom 12 may project beyond the side walls 13, 14 of the separating passage and thus form a base surface on which several or various passage walls can be arranged fixed in location with respect to each other at specific positions. This base surface for fixing the location of various passages or passage portions may also be formed between the passage walls, in particular at the open side of the passages, because here the greatest stability is required for the welding operation.

The wall thicknesses of the passage walls 13, 14 and the bottom wall 12 and of the cover 25 are in the range of 0.5 to 5 mm, particularly in the range of 1.5 to 3 mm.

As material for the separation channel 6 and the separation chamber 9 plastic suitable in particular for medical purposes may be used, preferably as transparent material.

Possible materials are for example polycarbonate, PVC or styrene. Furthermore, the walls 13, 14 and the bottom wall 12 may form a part on which the cover can be fitted for example by adhering, ultrasonic welding, vibration welding or thermal welding. It is further possible to secure the cover 15 by clamping action. The sealing of the separation passage is by the cover 15 and it is possible to provide guides as location aid for the closing.

Hereinafter with the aid of FIGS. 2 and 3 the drive disc of the centrifuge arrangement according to the invention will be described in detail.

Figure 2:
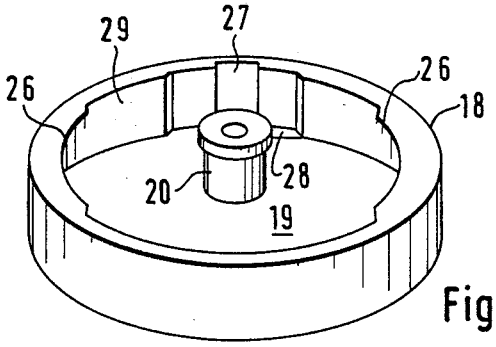
FIG. 2 is a view corresponding to FIG. 1 of a drive disc of a centrifuge rotor of the centrifuge arrangement according to the invention.

According to FIG. 2 the drive disc 18 comprises a circular base plate 19 which is also shown in FIG. 3. Arranged centrally on the base plate 19 is a cylindrical member 20 which according to FIG. 3 comprises a central passage recess 21 and adjoining the latter in the lower region a recess of enlarged diameter which serves for connection of a drive source not shown, the recess possibly being provided for example with a V-groove profile.

In the passage recess 21 the inlet and outlet tubes, also not illustrated, are introduced and lead to the separation chamber or separation passage and are closed by means of a lever 22 which is latched into engagement.

As shown by the illustration of FIG. 3 the drive disc 18 comprises a means 23 on which the separation container 1 bears via the separation passage 6 or the separation chamber 9, said means 23 being fixedly disposed on the drive disc 18 or the base plate 19 thereof. To be more exact, the means 23 comprises faces directed towards the axis of rotation of the drive disc 18 and represnting in the example of embodiment, due to the circular configuration, an annular face or wall 29. Said wall 29 is substantially perpendicular on the drive disc 18 or the bottom plate 19 thereof. Also formed in the surface of the bottom plate 19 is a groove 24 which as apparent in detail from FIG. 3 adjoins the wall 29 and extends from the latter on the axis of rotation of the drive disc 18. As further apparent from FIG. 3 the width of the groove 24 is somewhat greater than the width of the separation passage 6, although this is not essential.

As further apparent from joint observation of FIG. 2 and FIG. 3 the wall 29 extends round the radially outermost edge of the drive disc 18 and surrounds the entire periphery thereof, i.e. forms a closed ring.

As also apparent from FIG. 2 and FIG. 3 the wall 29 comprises at its upper edge a radially inwardly projecting projection 25 which also runs round the entire edge and preferably two opposite regions 29 of reduced diameter, as can be seen exactly in FIG. 2. Thus, altogether the projection 25 forms a ring extending round the entire periphery of the wall 29 and having a smaller internal diameter than the internal diameter of the annular wall 29 and therefore engages over at least a portion of the separation container 1 or the cover 15 thereof so that it can prevent undesirable slipping out of the separation container 1 in a direction away from the base plate 19.

FIG. 3 shows the condition in which the separation container 1 is inserted into the drive disc 18. As has already been described above the separation container 1 due to the use of flexible material has a resiliency which makes it possible to move the ends 2, 3 towards each other and this in turn allows the separation container 1 to be inserted into the drive disc 18 in spite of the projection 25. For this purpose the ends 2, 3 are moved towards each other by compressing the grip portions 5, the separation container 1 inserted and then the ends 2, 3 released, whereupon due to the inherent elasticity of the separation container 1 they move away from each other again and thus assume the position shown in FIG. 3 in which the separation container 1 bears via the outer walls 13 on the wall 29 and is secured against undesirable slipping out upwardly by a projection 25. This simple insertion and securing of the separation container 1 is made possible by the annular separation passage 6 having in the state in which the ends 5 are pressed together a smaller diameter than it has in the inserted state. If it is necessary to remove the separation container 1 for any reason all that is need is to move ends 2, 3 towards each other again, whereafter the separation container 1 can be easily removed from the drive disc 18. Furthermore, this configuration has the advantage of reducing the material required for the separation container 1 because the centrifugal forces occurring in operation of the centrifuge arrangement can be transferred to the wall 29 of the drive disc 18 and are taken up by the latter so that the separation container 1 itself is relieved to a great extent and consequently it is not necessary to make said container particularly strong and stable. In the formation of the channel configurations no account of the balance behaviour need be taken because the separation container 1 is only balanced together with the drive disc 18, i.e. balance weights need only be fitted to the drive disc. To facilitate insertion and removal of the separation container 1 and to arrest the latter reliably at the inner face of the drive disc 18 further recess 27 is provided. In complementary manner the separation container 1 has at its ends 2, 3 corresponding projections 30. To enable the behaviour during separation of the fluid to be observed in the base plate 19 of the drive disc a hole 28 may be provided.

In operation of the centrifuge arrangement according to the invention in which according to FIG. 3 the separation container 1 is inserted into the drive disc 18, blood for example is introduced through an inlet passage disposed on the tubular member 7 into the separation passage 6 and in the outer region, i.e. adjacent the wall 13, erythrocytes for example collect whereas in the inner region, i.e. adjacent the wall 14, the blood plasma collects. These two components migrate in combination with the thrombocytes during the centrifuging into the separation chamber 9 from whence they can be removed via the tube member 8 or the withdrawal tubes 10, 11, 11' separately as indicated in FIG. 5. Because of the constant cross-sectional form, in particular of the separation passage 6, a laminar uniform flow results which is important and advantageous in particular with thrombocyte-poor plasma in order to obtain satisfactory centrifuging.

After charging with the material to be centrifuged the centrifuge arrangement according to the invention also has the advantage that it can be easily flushed because the passage form does not depend on the filling material and pressure and thus does not collapse after removing the material to be centrifuged.

It should be further emphasized that the widening of the separation chamber outwardly favours the separation of the components of the material to be centrifuged and by a region 27 additionally cut out adjacent the wall 16 of the separation chamber 9 the latter can be completely flushed free from residues by introducing saline solution. This cutout region is connected to the end of the withdrawal tube member 11' so that therethrough in conjunction with a flexible tube of a tubing system connected to the members 7, 10, 11, 11' but no shown erythrocytes or saline solution can be removed.

Figure 6:
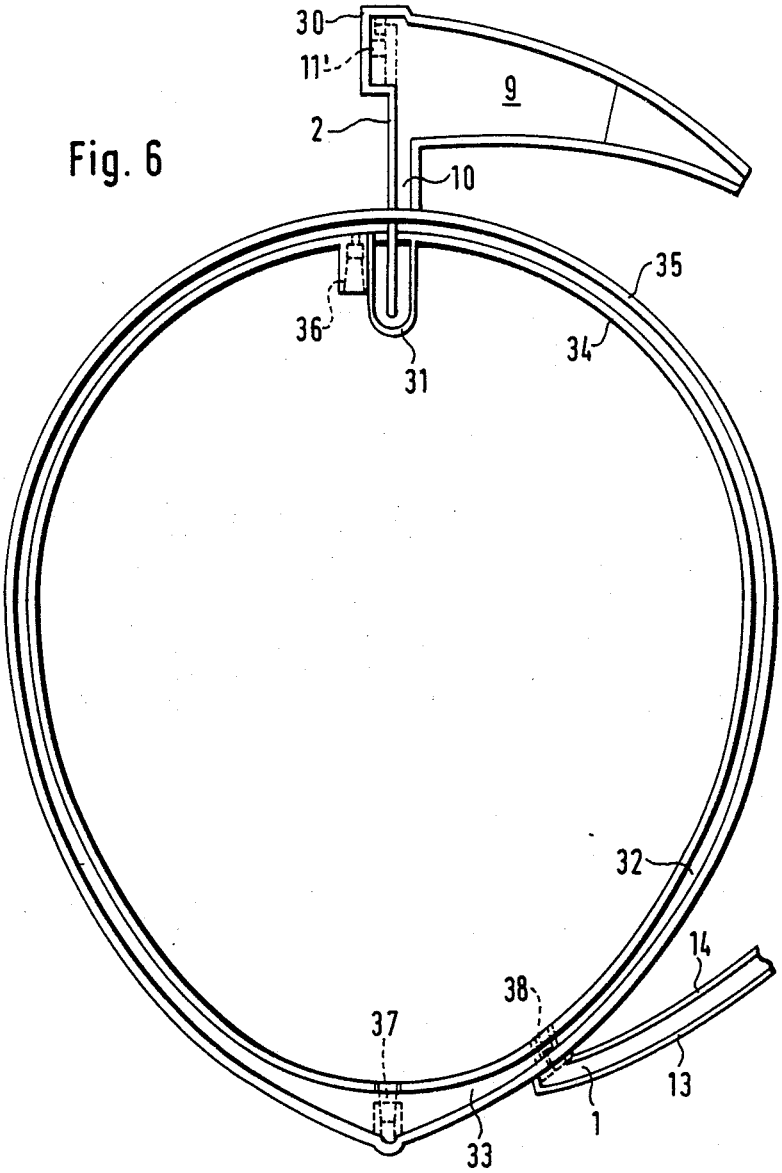

In a particular embodiment according to FIG. 6 the separation passage is formed only as almost semicircular element and contains at its one end 2 the separation chamber 9 already described in its embodiment according to FIGS. 4 and 5. However, in this case the member 10 leads as U-shaped passage 31 having a gradient to an egg-shaped second separation container 32. Said separation container 32, lying in the interior of the semicircular element, also comprises a substantially rectangular cross-section and includes a channel bottom 33 and fixed channel walls 34 and 35 fixedly connected to the channel bottom and vertically upright on the latter. The correspondingly remaining open side is sealed by means of a permanently fitted fluid-tight cover.

In the vicinity of the passage 31 on the separation container 32 at its inwardly directed side a connecting piece 36 is provided and at its opposite side, the outermost point of the separation container 32, a further withdrawal connecting piece 37. The latter is preferably made extending inclined inwardly and downwardly. In this region the cross-section of the separation container 32 may be increased to obtain a collecting space. At the end of the separation passage 1 opposite the separation chamber 9 the supply tube piece 38 is disposed.

The arrangement of this two-stage separation container 1, 32 is carried out in correspondingly suitable manner on a drive disc which is not shown.

For example, during operation of the centrifuge arrangement the blood is introduced via the supply connecting tube 38 into the separation container 1 and in the outer region, i.e. adjacent the wall 13, erythrocytes for example collect whereas in the inner region, i.e. adjacent the wall 14, blood plasma collects. These two components migrate in combination with the thrombocytes during the centrifuging into the separation chamber 9 and the erythrocytes can be removed from the withdrawal tube member 11'. The thrombocyte-containing plasma is conducted via the withdrawal tube member 10 and the U-shaped passage 31 into the egg-shaped second separation container 32. In a second separation stage in said container the thrombocytes are separated from the blood plasma and under the centrifugal forces they move into the region of the withdrawal tube member 37 from which the thrombocytes are removed. The remaining plasma water goes to the opposite side of the separation container 32 to the tube member 36 via which the plasma water is withdrawn from the separation container 32.

A combination arrangement will also be conceivable of separation container 1 according to FIG. 4 and egg-shaped second separation container 32, also being connected via the member 10 and passage 31 as described above. The only difference would be that the supply member 38 would be at the opposite end 3.

We claim:

1. Centrifuge arrangement comprising a centrifuge rotor which has the following components:

a drive disc, a substantially perpendicular annular wall defining an inwardly disposed face formed on the periphery of said drive disc, a separation container disposed on the drive disc, said separation container defining outer surfaces, at least parts of the separation container outer surfaces bearing against said inwardly disposed face of said annular wall, a groove formed in the surface of the drive disc adjacent said annular wall, said separation container defining a bottom surface seated in said groove, said separation container comprising a separation passage, an inlet passage and a plurality of outlet passages for fluids, the separation container being formed as a self-supporting part of flexible material, and including an upper wall for said separation container, said upper wall forming a fluid-tight cover for the separation passage.

2. Centrifuge arrangement according to claim 1, in which the annular wall is disposed at the radially outermost edge of the drive disc and extends around the entire periphery thereof.

3. Centrifuge arrangement according to claim 1, in which the annular wall comprises at its upper edge a radially inwardly extending projection.

4. Centrifuge arrangement according to claim 3, in which the projection runs round the entire periphery of the annular wall and thus forms a ring of lesser internal diameter than the internal diameter of the annular wall.

5. Centrifuge arrangement according to claim 1, in which the separation container is constructed as a ring and is inserted under bias into the space defined by the annular wall on the drive disc.

6. Centrifuge arrangement according to claim 5, in which the separation container after location in the drive disc defines a smaller distance from the rotation axis than in the non-located state.

7. Centrifuge arrangement comprising a centrifuge rotor which has the following components:

a drive disc, a base plate defined by said drive disc, an upstanding annular wall defining an inner surface formed on the periphery of said base plate, a separation container comprising a separation passage formed by inner, outer, upper and lower boundary walls, an inlet passage and a plurality of outlet passages for fluids, the separation container being formed of rigid or semi-rigid material providing a self-supporting part substantially free of diameter and height fluctuations during operation, said separation container being sufficiently flexible to permit placement of the outer boundary wall thereof in bearing engagement with said inner surface of said annular wall upon location of the separation chamber in said drive disc, and wherein the inner boundary wall is substantially free of support during operation.

8. Centrifuge arrangement according to claim 7 wherein one of the boundary walls is formed as a fluid-tight cover permanently attachable to an open side defined by the other boundary walls forming the separation passage.

9. Centrifuge arrangement according to claim 7, in which the separation container comprises one or more separation passages which are circular in a broad region and which at least in relatively large sub-regions have a rectangular cross-section and are connected to a separation chamber.

10. Centrifuge arrangement according to claim 7, in which the separation passage further comprises two substantially perpendicular passage walls fixedly connected to the passage bottom.

11. Centrifuge arrangement according to claim 7, in which the opposite ends of the separation container comprise one or more radially outwardly extending projections which engage in a corresponding depression defined by said annular wall.

12. Centrifuge arrangement according to claim 7, in which the separation container is an unclosed ring whose opposing ends define an intermediate space.

13. Centrifuge arrangement according to claim 7, in which the separation passage is formed from two passage walls disposed concentrically.

14. Centrifuge arrangement according to claim 7, in which with a two-stage separation a further separation container is disposed within the inner circle defined by the first-mentioned separation container.

15. Centrifuge arrangement according to claim 7, in which said further separation container comprises an egg-shaped configuration.

16. Centrifuge arrangement according to claim 7, in which said further and said first-mentioned separation containers are connected via a passage whereby fluids first separated in one container are transferred to the other container for further separation.

* * * * *